United States Patent [19]

Avery

[11] Patent Number: 4,492,314

[45] Date of Patent: Jan. 8, 1985

[54] REINFORCED TANK WALL STRUCTURE FOR TRANSFORMERS

[75] Inventor: Randall N. Avery, Franklin Park, Pa.

[73] Assignee: Westinghouse Electric Corp., Pittsburgh, Pa.

[21] Appl. No.: 594,058

[22] Filed: Mar. 28, 1984

[51] Int. Cl.[3] ..... B65D 7/42

[52] U.S. Cl. ..... 220/71; 220/3

[58] Field of Search ..... 220/71, 72, 1 B, 3, 220/85 TC; 52/108

[56] References Cited

U.S. PATENT DOCUMENTS

| | | | |
|---|---|---|---|
| Re. 27,330 | 4/1972 | Marcmann | 220/9 F |
| 1,331,089 | 2/1920 | Berry . | |
| 2,813,655 | 11/1957 | Hall | 220/71 |
| 2,983,401 | 5/1961 | Murphy | 220/10 |
| 3,088,621 | 5/1963 | Brown | 220/9 |
| 3,412,891 | 11/1968 | Bastone et al. | 220/3 X |
| 3,570,700 | 3/1971 | Yamamoto et al. | 220/10 |
| 3,623,626 | 11/1971 | Bridges | 220/15 |
| 3,719,302 | 3/1973 | Hamilton et al. | 220/9 LG |
| 4,163,347 | 8/1979 | Marcmann | 52/105 |
| 4,181,237 | 1/1980 | Kenyon et al. | 220/71 |

*Primary Examiner*—Steven M. Pollard

*Attorney, Agent, or Firm*—L. P. Johns

[57] ABSTRACT

A reinforced structure for resisting deflection of a tank wall that is subjected to a range of positive and negative pressures within the tank characterized by a plurality of closely spaced braced members disposed in general alignment and mounted on the tank wall so that upon limited deflection of the wall the brace members move into contact and thereby increase wall resistance to additional damaging deflection.

10 Claims, 10 Drawing Figures

REINFORCED TANK WALL STRUCTURE FOR TRANSFORMERS

BACKGROUND OF THE INVENTION

1. Field of the Invention

This invention relates to a reinforcing structure for resisting deflection of a tank wall that is subjected to a range of positive and negative pressures within the tank, and more particularly it pertains to a tank for a transformer.

2. Description of the Prior Art

Power transformers are the subject of constant design changes in order to improve their cost and efficiency. In particular, large tank structures for containing transformers are exposed to varying temperature conditions incurred by internal and external environments. Moreover, transformer tanks are subjected to wide variations in pressure during testing and subsequent start-up periods. For example, when a transformer tank is filled with a dielectric coolant for a liquid-cooled transformer, the tank is preliminarily evacuated to a pressure of about −14.7 psig in order to minimize the gas content of the coolant. During subsequent operation of the transformer the pressure on the tank often reaches a pressure of about 8 psig. As a result a tank wall is subjected to positive and negative pressures within the tank which has created problems in designing transformers having lower cost and higher efficiencies.

SUMMARY OF THE INVENTION

It has been found in accordance with this invention that a reinforced wall structure for resisting deflections of a tank wall subjected to a range of positive and negative pressures may be comprised of a tank wall having bracing means on the wall for limiting inward and outward deflections of the wall in response to pressure variations thereon. The bracing means includes a brace member on the wall for stiffening the wall and including a plurality of spaced brace members disposed in general alignment so that upon limited deflections of the wall, the brace members move into contact to thereby increase wall resistance to additional damaging deflections.

The advantage of the reinforced wall structure of this invention is that it is conductive to a number of changes in internal design of modern transformer which enable a reduction in the tank weight and oil volume.

DESCRIPTION OF THE PREFERRED EMBODIMENTS

Figure 1:
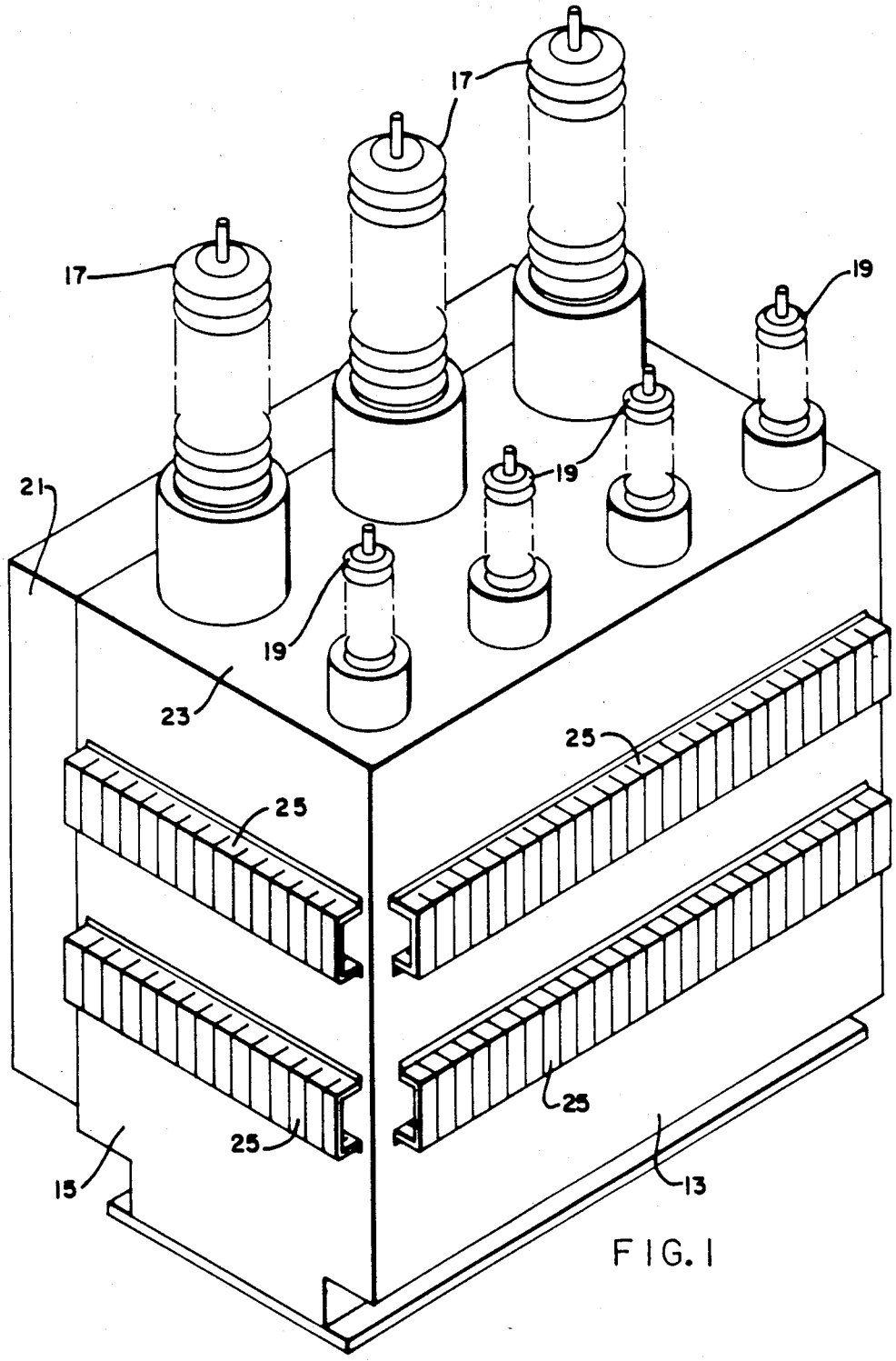
FIG. 1 is a schematic view of a power transformer tank embodying the reinforced wall structure of this invention.

The external features of a power transformer are shown in FIG. 1. The reinforced wall structure of this invention is useful for tanks of varying purpose where they are subjected to a range of positive and negative pressures. For example, a power transformer is generally indicated at 11 in FIG. 1 and it comprises a rectangular tank having walls 13, 15, high-voltage bushings 17, low-voltage bushings 19, cooling panels 21, and a top wall 23. The tank contains a three-phase transformer which is enclosed within a dielectric liquid coolant. A gas chamber is disposed above the liquid coolant. The transformer structure, the liquid coolant, and the gas are not shown in the drawing to facilitate the illustration.

Heretofore, transformer tanks included wall structures that accommodated positive and negative pressures for which purpose the walls were too thick for deflection in and out, or had wall braces for reinforcement in order to accommodate a large gas space above the liquid coolant. A more recent trend in tank structure has been to provide walls with more flexibility, whereby less gas space is necessary due to wall bulging for which few, if any, wall braces are required. However, the tank walls must withstand full vacuum which is the real reason for wall braces. The tanks are made to allow for thermal expansion of the fluid which, in turn, heats up and compresses the gas (nitrogen) above the fluid. The current tendency is to reduce the gas space at the top by letting the tank bulge or deflect outwardly. By providing a reduced gas space advantages are incurred including reduced cost, reduced shipping weight, and reduced size which permits truck transportation as compared with rail transportation. The more the tank walls bulge, the less pressure created in the tank. The less pressure created, the less tank strength is required which, in turn, is conducive to more tank wall flexibility.

More particularly, the tanks are designed to accommodate a vacuum, such as −14.7 psig, but at the same time being as flexible as possible under positive pressure. Accordingly, the tank is designed to accommodate a pressure range of from about 8 to about −15 psig.

Figure 2:
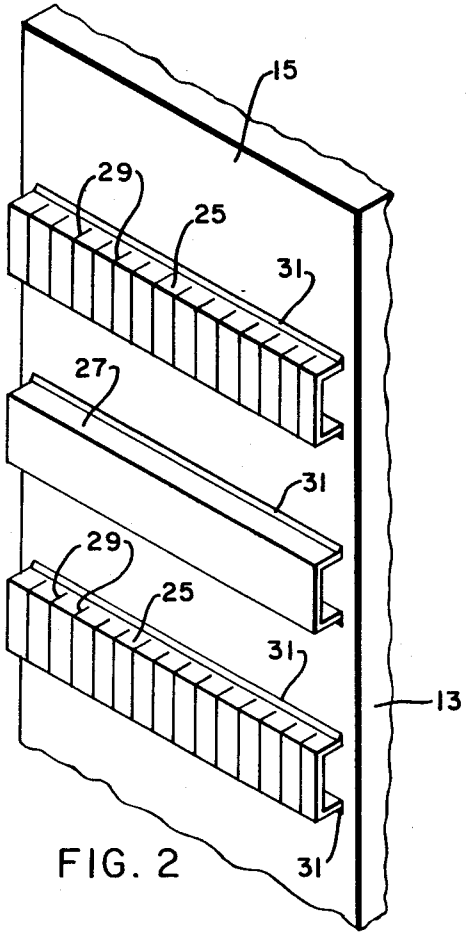
FIG. 2 is a fragmentary view showing segmented braces having a channel-like cross section located on a transformer tank wall.

In accordance with this invention, a tank wall is provided with braces or brace members 25 which are adapted to restrain positive and negative pressure on the tank wall. As shown in FIG. 2 braces 25 are comprised of channel members, preferably steel, which are mounted at spaced locations between the top and bottom of the transformer wall 15. The number of braces on a wall is dependent upon such considerations as variations in wall thickness, and the size of the wall. For example, since the pressure varies from about 8 to −14.7 psig, there should be about twice the number of braces for negative pressure as that restraining the positive pressure. Three braces (FIG. 2) are elongated channel members with the braces 25 having spaced slots 29 disposed at preferably equally spaced locations around the longitudinal axis of the channel member. The edges of the channel are secured, such as by welding, at 31 to the tank wall along the entire length of the upper and lower legs of the channel. The brace 27 is preferably unslotted and is similarly secured, such as by welds 31, to the center of the tank wall. However, the brace 27 may also be provided with slots 29 where necessary, depending upon the thickness and size of the wall 15. The slots 29 are narrow, having a width of about and may be preferably provided by a saw blade.

Figure 3:
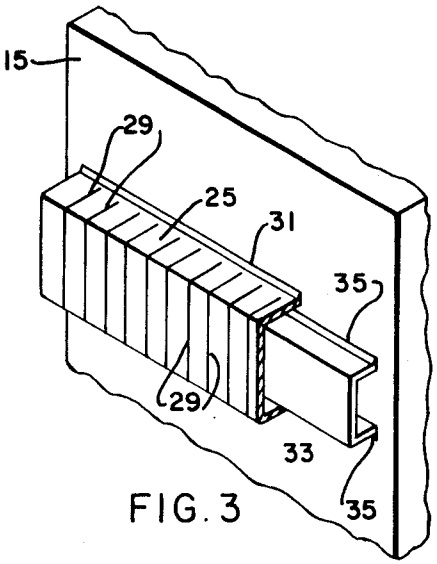
FIG. 3 is a fragmentary view showing another embodiment of segmented braces having nested channel-like cross sections.

Another embodiment of the invention includes nested braces 25, 33 (FIG. 3). Brace 33 has a preferably channel configuration of smaller dimension than the brace 25 and includes legs which are secured, such as by welding at 35 to the tank wall 15. The braces 33 are not slotted and provide the ½ strength necessary for positive pressure. Braces 33 and slotted brace 25 act together under negative pressure, doubling the strength of the bracing system.

Figure 4:
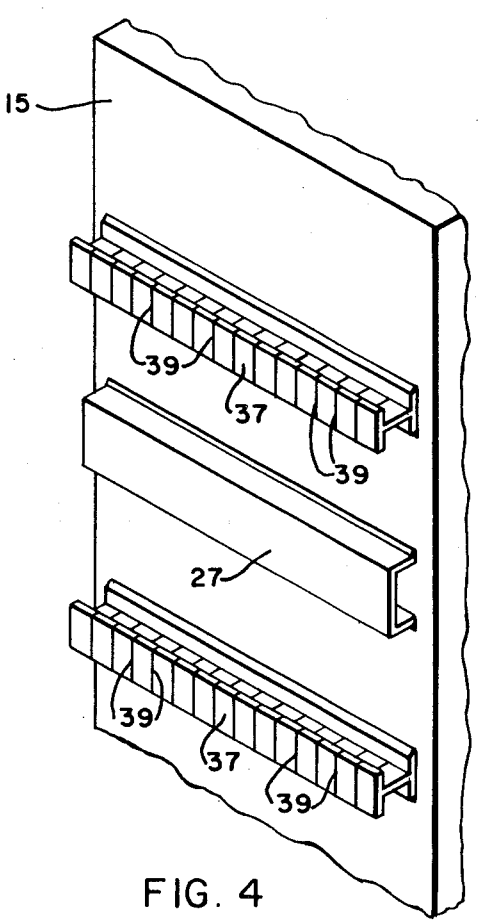
FIG. 4 is a fragmentary view of another embodiment of segmented braces having I-beam cross sections.

Another embodiment of the invention includes braces 37 (FIG. 4) having spaced slots 39 similar to the slots 29. As shown, the cross-sectional area of the braces 37 is that of an I-beam through which the spaced slots 39 extend through the outer flange and web.

Figure 5:
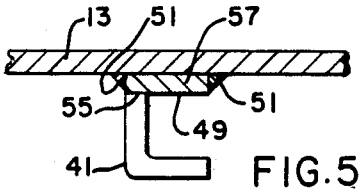
FIGS. 5, 6, 7, and 8 are sectional views through segmented braces having varying cross sections.
Figure 6:
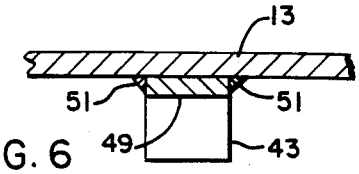
Figure 7:
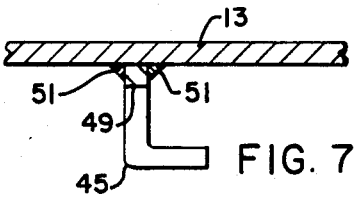

Other embodiments of the invention are shown in FIGS. 5–7 which include a brace 41 having a C-shaped configuration, a brace 43 of solid bar configuration, an L-shaped brace 45, and a brace 47 having an inverted T-shape. All of the braces 41, 43, 45 are slotted from their outer surface to locations 49 which are spaced from the inner surface welds 51 where the braces are mounted on the tank wall 13.

In accordance with this invention the several slots 29 have two configurations. One configuration comprises slots extending from the outer surface, such as surface 53, to a location 55 (FIG. 5) in the C-brace 41. This leaves an unslotted brace portion 57 adjacent to the tank wall 13 which is continuous throughout the length of the brace from one end to the other. This unslotted portion is used to facilitate handling, alignment and welding.

Figure 8:
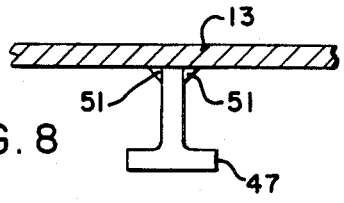

Another configuration of the slots 29 comprises slots extending from the outer surface of the brace to the tank wall 13, leaving no unslotted portion of the brace (FIG. 8). Thus, each brace, whatever its configuration, has segmented separate portions which are separately mounted, such as by welding at 51, (FIG. 8) onto the tank wall 13.

Figure 9:
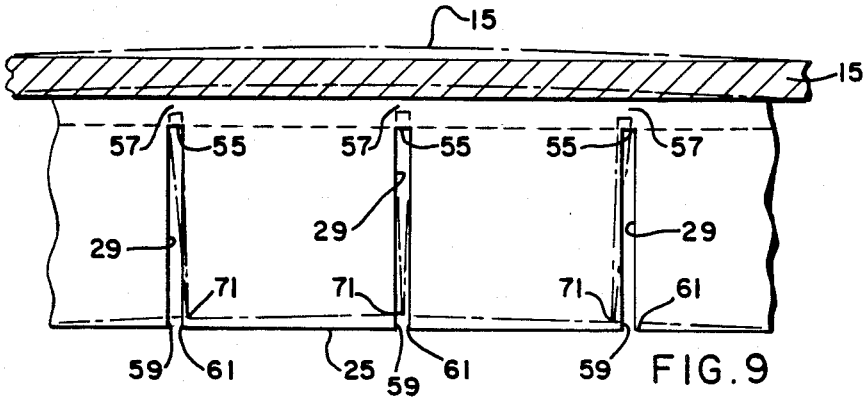
FIG. 9 is a fragmentary sectional view showing a section of segmented braces which are integral with an elongated member attached to the tank wall.

As shown in FIG. 9 where the slots 29 terminate at a location 55 spaced from the surface of the wall 13 for the channel braces 25, the non-slotted portion 57 remains as a reinforcing part of the brace and operates primarily to reinforce the wall when a positive pressure within the wall deflects the wall outwardly. In other words, the non-slotted portion 57 of the braces reinforces the tank wall 13 in response to positive pressure within the tank.

Figure 10:
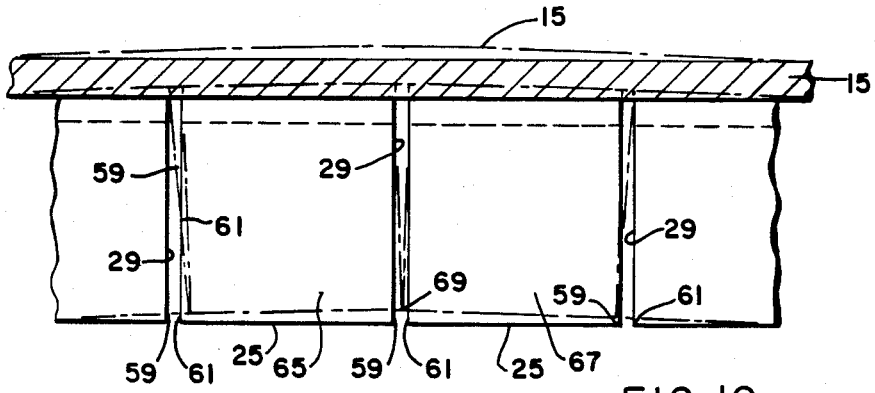
FIG. 10 is a sectional view showing segmented braces which are separately attached to a tank wall.

Where, however, the slots 29 extend all the way through the several braces to the surface of the tank wall (FIG. 10), there is no unslotted portion 57 left to function as reinforcement for the tank wall 13 when it is deflected outwardly in response to a positive pressure within the tank.

In response to a negative pressure within the tank, when the tank wall 13 is deflected inwardly, the wall 15 bulges or is deflected inwardly the slots close. That is, the closely spaced, oppositely facing surfaces 59, 61 of adjacent brace segments 63, 65, 67 are brought into contact, such as at 69 (FIG. 10), due to slight shifting or movement of the segments 63, 65, 67, as shown by the broken line positions of those segments. Similarly, as shown in FIG. 9 the brace segments are brought together at contact points 71 in response to rotation of the brace segments when the wall 15 deflects inwardly in response to a negative pressure or vacuum condition within the tank.

Accordingly, when limited deflection of the wall occurs the brace segments move into contact to thereby increase wall resistant to additional damaging deflection.

In the embodiment shown in FIG. 9 in which the slots extend only partially through the braces, the unslotted portion of each brace resists further deflection of the tank wall. However, where the slots extend completely through the braces to provide separate spaced brace segments, the wall per se serves as a positive pressure restrainer and the separate braced segments 63, 65, 67 serve to accommodate the larger problem of wall resistance to a vacuum within the tank during testing and filling of the tank with dielectric coolant.

It is understood that the braces may be mounted on the interior surface of the tank walls, whereby the completely slotted or partially slotted segments function in a similar manner to prevent outward bulging of the tank. Such a condition could obtain where conditions such as tank wall thickness and/or size require the interior mounting of the braces.

In conclusion, the use of a slotted or sawn tank brace, either by itself or nested with another conventional brace, allows for a differential stiffness. Under positive pressure the brace readily deforms (where the braces are on the exterior wall surface), and the slots will open up. The ease with which this deformation occurs allows additional volume for the oil expansion. The brace will seemingly not be there. The tank will be suitable only for a positive pressure of 8 psig. On the other hand, under negative pressure, the outer flanges of the slotted brace is under compression. The slot closes and the brace is rigid and resists any further deflection. With the extra strength of the slotted braces, the tank easily withstands full vacuum requirements.

What is claimed is:

1. A reinforced wall structure for resisting deflection of a tank wall that is subjected to a range of positive and negative pressures within the tank, comprising:

(a) tank means for containing fluids and comprising a tank wall;

(b) brace means on the tank wall for limiting inward and outward deflections of the wall in response to pressure variations within the tank means;

(c) the brace means including a brace member on the wall and having a body portion including first and second surfaces with the first surface being secured to the tank wall and the second surface being spaced from the wall;

(d) the body portion having a plurality of narrow slots spaced longitudinally and generally normal to the longitudinal axis of the portion;

(e) each slot extending from the second surface and toward the wall.

2. The structure of claim 1 in which the slots extend from the second surface to the tank wall.

3. The structure of claim 1 in which the slots extend from the second surface to a location between the first and second surfaces.

4. The structure of claim 1 in which the brace member is mounted on the outer surface of the tank wall.

5. The structure of claim 1 in which the brace member is mounted on the inner surface of the tank wall.

6. A reinforced structure for resisting deflections of a tank wall that is subjected to a range of positive and negative pressures within the tank, comprising:

(a) tank means for containing fluids and comprising a tank wall; and (b) brace means mounted on the wall for stiffening the wall and including a plurality of spaced brace members disposed in general alignment so that upon limited deflection of the wall the brace members move into contact to thereby increase wall resistance to additional damaging deflection.

7. The structure of claim 6 in which the plurality of spaced brace members are mounted in general alignment on the wall.

8. The structure of claim 6 in which the plurality of spaced brace members are integral parts of an elongated member mounted on the wall.

9. The structure of claim 8 in which the adjacent brace member includes closely spaced, oppositely facing surfaces that move into surface-to-surface contact upon limited deflection of the wall.

10. A reinforced wall structure for electrical equipment, comprising:

(a) tank means for containing fluids and comprising a tank wall;

(b) electrical equipment within the tank means;

(c) brace means on the tank wall for limiting inward and outward deflections of the wall in response to fluid pressure variations within the tank means;

(f) the brace means including a plurality of brace members disposed in general alignment so that upon limited deflection of the wall the brace members move into contact to thereby increase wall resistance to additional damaging deflection.

* * * * *